US011673776B2

(12) United States Patent
Chapuis et al.

(10) Patent No.: US 11,673,776 B2
(45) Date of Patent: Jun. 13, 2023

(54) LUFFING BOOM TOWER CRANE EQUIPPED WITH AN ADJUSTABLE WIND LOAD SYSTEM

(71) Applicant: MANITOWOC CRANE GROUP FRANCE, Dardilly (FR)

(72) Inventors: Pierre-Jean Chapuis, Lissieu (FR); Grégory Alamome, Rillieux la Pape (FR); Lotfi Bouskine, Caluire et Cuire (FR); Vincent Veillerot, Tassin la Demi Lune (FR); Jérémy Blasiak, Fleurieux sur L'Arbresle (FR)

(73) Assignee: MANITOWOC CRANE GROUP FRANCE, Dardilly (FR)

( * ) Notice: Subject to any disclaimer, the term of this patent is extended or adjusted under 35 U.S.C. 154(b) by 109 days.

(21) Appl. No.: 17/138,800

(22) Filed: Dec. 30, 2020

(65) Prior Publication Data

US 2021/0214196 A1 Jul. 15, 2021

(30) Foreign Application Priority Data

Jan. 14, 2020 (FR) ..... 2000281

(51) Int. Cl.
*B66C 23/88* (2006.01)
*B66C 23/16* (2006.01)

(52) U.S. Cl.
CPC ..... *B66C 23/88* (2013.01); *B66C 23/16* (2013.01)

(58) Field of Classification Search
CPC ..... B66C 23/022; B66C 23/16; B66C 23/163; B66C 23/62; B66C 23/64; B66C 23/84; B66C 23/88; B66C 23/94; B66C 13/22; B66C 13/30
See application file for complete search history.

(56) References Cited

FOREIGN PATENT DOCUMENTS

| | | |
|---|---|---|
| CN | 203667857 U | 6/2014 |
| EP | 3064465 A1 | 9/2016 |
| WO | 2020/100145 A1 | 5/2020 |

OTHER PUBLICATIONS

FR search report and written opinion dated Sep. 29, 2020, issued in connection with corresponding FR Pat. Appl. No 20/00281.

*Primary Examiner* — Michael R Mansen
*Assistant Examiner* — Juan J Campos, Jr.
(74) *Attorney, Agent, or Firm* — Cook Alex Ltd.

(57) ABSTRACT

A tower crane includes a tower on which is pivotally mounted a boom displaceable between a lowered position and a raised position. The crane is configurable between a service configuration in which the boom is controlled in rotation and a weather vane configuration in which the boom is in the raised position and is released in rotation on the tower to allow orientation in the direction of the wind. A wind load system is mounted on the boom and is adjustable between a retracted shape in the service configuration providing a reduced surface exposed to the wind, and a deployed shape in the weather vane configuration providing an extended surface exposed to the wind. The wind load system is configured to move from the retracted shape to the deployed shape under the effect of its own weight alone (i.e., under gravity) when the boom is raised.

10 Claims, 4 Drawing Sheets

LUFFING BOOM TOWER CRANE EQUIPPED WITH AN ADJUSTABLE WIND LOAD SYSTEM

FIELD

The invention relates to a luffing boom tower crane equipped with an adjustable wind load system. Furthermore, the present invention concerns a method for securing a luffing boom tower crane.

The present invention applies to the field of tower cranes comprising a luffing boom, and can be applied to several crane structures, for example to structures composed of lattices and chords.

BACKGROUND

Conventionally, a tower crane comprises a tower on which a boom is pivotally mounted about an orientation axis, generally vertical, this boom being displaceable in elevation and in lowering between a lowered position and a raised position, for example by means of a hydraulic system or a cable system.

Moreover, such a tower crane can be configured between:

- a service configuration in which the boom is controlled in rotation on the tower around the orientation axis (also called an orientation control) to displace a load by means of a lifting system carried by the boom, and
- a weather vane configuration in which the boom is in a raised position and is released in rotation on the tower around the orientation axis, in order to be able to be oriented in the direction of the wind, the boom is then free to turn about the orientation axis and it is conventional to say that the boom is turned into a weather vane.

Indeed, particularly in the event of strong winds, it is recommended, or even mandatory, to make the tower crane weather vane (also called weather vane of the boom), by disengaging the boom (in other words by releasing the boom in rotation on the tower, for example by unblocking the orientation brakes) so that the boom is free to rotate to be automatically oriented in the direction of the wind and thus allow the crane to be left without human supervision.

In the case of a luffing boom crane, the weather vane is carried out with the boom in the raised configuration to minimize the radius of gyration of the boom and thus prevent the boom, as a weather vane, over surfaces near the construction site, such as traffic lanes, buildings, etc.

When the crane is in the weather vane configuration, the balance between the wind load of the boom must be favorable in relation to the tailwind load (at the counter-boom) so that the boom is naturally orientated in the wind. However, on a luffing boom crane, with the raised boom, the orientation torque resulting from the force of the wind on the boom is reduced and the wind vane (or alignment in the direction of the wind) is later or even difficult.

In order to ensure this weather vane setting, it is known, in particular from document EP3064465, to provide on the boom a wind load system (also called a wing system) provided with one or more sails which provide an adjustable surface exposed to the wind, and particularly a surface exposed to the wind which is increased when the boom is in the safety configuration, so as to increase the wind pressure on the boom of the crane and thus allow it to be better oriented in the direction of the wind. This document EP3064465 proposes to use a drive mechanism which acts on the sail(s) to deploy them (and thus increase their surface exposed to the wind) or retract them (and thus reduce their surface exposed to the wind).

However, the use of such a drive mechanism has the drawback of complicating the installation of such a wind load system, and thus of increasing the cost of installation, sometimes in a prohibitive manner when it is required to install a wind load system on an existing crane, or to redesign a crane to incorporate this functionality of adjustable wind load surface. Moreover, the presence of an additional drive mechanism in a boom makes it heavier, and thus penalizes the load curve of the boom and therefore reduces the performance of the crane.

SUMMARY

The object of the present invention is in particular to resolve all or part of the aforementioned drawbacks, by proposing a wind load system which is of a light, simple and inexpensive design, to promote installation on existing cranes or to easily design new cranes with a wind load system.

Another object of the invention is to propose a wind load system which, due in particular to its lightness, will allow a large surface exposed to the wind to be deployed in a weather vane configuration, which authorizes increasing the luffing angle of the boom (in other words to bring it closer to the vertical), and therefore reducing the radius of gyration of the boom in this weather vane configuration, while allowing effective alignment in the direction of the wind.

To this end, the invention provides a tower crane comprising a tower on which a boom is pivotally mounted about an orientation axis, this boom being displaceable in elevation and in lowering between a lowered position and a raised position, and the tower crane being configurable between a service configuration in which the boom is controlled in rotation on the tower around the orientation axis, and a weather vane configuration in which the boom is in a raised position and is released in rotation on the tower around the orientation axis to be able to be oriented in the direction of the wind, wherein the tower crane comprises at least one wind load system mounted on the boom and adjustable between a retracted shape used in the service configuration and in which the wind load system provides a reduced surface exposed to the wind, and a deployed shape used in the weather vane configuration and in which the wind load system provides an extended surface exposed to the wind that is greater than the reduced surface exposed to the wind.

Accordingly, in a tower crane of an embodiment herein, the wind load system is designed to move from the retracted shape to the deployed shape under the effect of its own weight alone when the boom is raised to move from the lowered position to the raised position.

Thus, the invention proposes to dispense with a drive mechanism to deploy the wind load system, and thus to increase the surface exposed to the wind, by exploiting the own weight of the wind load system, which will allow, when raising the boom, a deployment by gravity. In other words, when the boom is raised, the boom changes its inclination relative to the vertical, and thus the wind load system will naturally change its shape, under the effect of gravity which naturally applies a vertical force to the wind load system.

Such a wind load system thus enables a "control" by gravity which avoids any addition of dead weight in the boom and which therefore does not penalize the performance of the crane. This wind load system also makes it possible to naturally have a maximum surface exposed to the wind when the crane is in the weather vane configuration, and a minimum surface exposed to the wind when the crane is in the service configuration and needs orientation performance.

It should be noted that, just as naturally, the wind load system is designed to move from the deployed shape to the retracted shape under the effect of its own weight alone when the boom is lowered to move from the raised position towards the lowered position.

In a particular embodiment, the wind load system comprises at least two wing elements, the wing elements including at least one freely movable wing element, wherein:

- in the retracted shape, the wing elements are at least partially superimposed on each other when the boom is in the lowered position in order to provide the reduced surface exposed to the wind; and
- in the deployed shape, the wing elements are spaced apart from each other when the boom is in the raised position in order to provide the extended surface exposed to the wind.

The freely movable wing element(s) are freely displaced under the effect of their own weight alone when the boom is raised to move from the lowered to the raised position.

Thus, the freely movable wing element(s) will in a way fall, under their own weight, when the boom is raised, while of course being retained on the boom, and it is this movement which changes the freely movable wing element shape.

It should be noted that, just as naturally, the freely movable wing element(s) are freely displaced under the effect of their own weight alone when the boom is lowered from the raised position to the lowered position.

According to one feature, the freely movable wing element(s) are movable at least in rotation.

Thus, the freely movable wing element(s) will at least pivot, under their own weight, when the boom is raised.

According to one possibility, the freely movable wing element(s) are movable in rotation around the same axis of rotation.

According to another feature, the freely movable wing element(s) are movable at least in sliding.

Thus, the freely movable wing element(s) will at least slide, under their own weight, when the boom is raised.

According to another possibility, the wind load system comprises at least one stop associated with a freely movable wing element to stop said freely movable wing element in its mobility when the boom is raised to move from the lowered position towards the raised position.

The presence of the stop advantageously makes it possible to stop the free wing element associated at the desired place in order to have a surface exposed to the maximum wind, the stop providing a sort of control as to the amplitude of the deployment or as to the final positioning of the free wing element.

According to another possibility, the wind load system comprises a static wing element and one or more freely movable wing elements, the freely movable wing element(s) being superimposed at least partially in front of or behind the static wing element in the retracted shape.

In a particular embodiment, the wing elements of the wind load system are made at least partially in one of the materials selected from: a metallic material, such as for example aluminum, a plastic material, a textile material, a composite material.

According to one possibility, the wing elements of the wind load system are planar and parallel to each other in the deployed shape.

The invention also relates to a securing method for securing a tower crane according to the invention, the method comprising:

- a step of releasing the rotating boom on the tower around the orientation axis, to be able to be oriented in the direction of the wind;
- a step of raising the boom to move from the lowered position in which the wind load system is in its retracted shape towards the raised position in which the wind load system is in its deployed shape;

wherein, during the raising of the boom, the wind load system moves from the retracted shape to the deployed shape under the effect of its own weight alone.

In the embodiment with wing elements, during the raising of the boom, the freely movable wing element(s) are freely displaced under the effect of their own weight alone to increase the surface exposed to the wind of the wind load system.

BRIEF DESCRIPTION OF THE DRAWINGS

Other features and advantages of the present invention will become apparent on reading the detailed description below, of non-limiting implementation examples, made with reference to the appended figures in which.

DESCRIPTION

Figure 1:
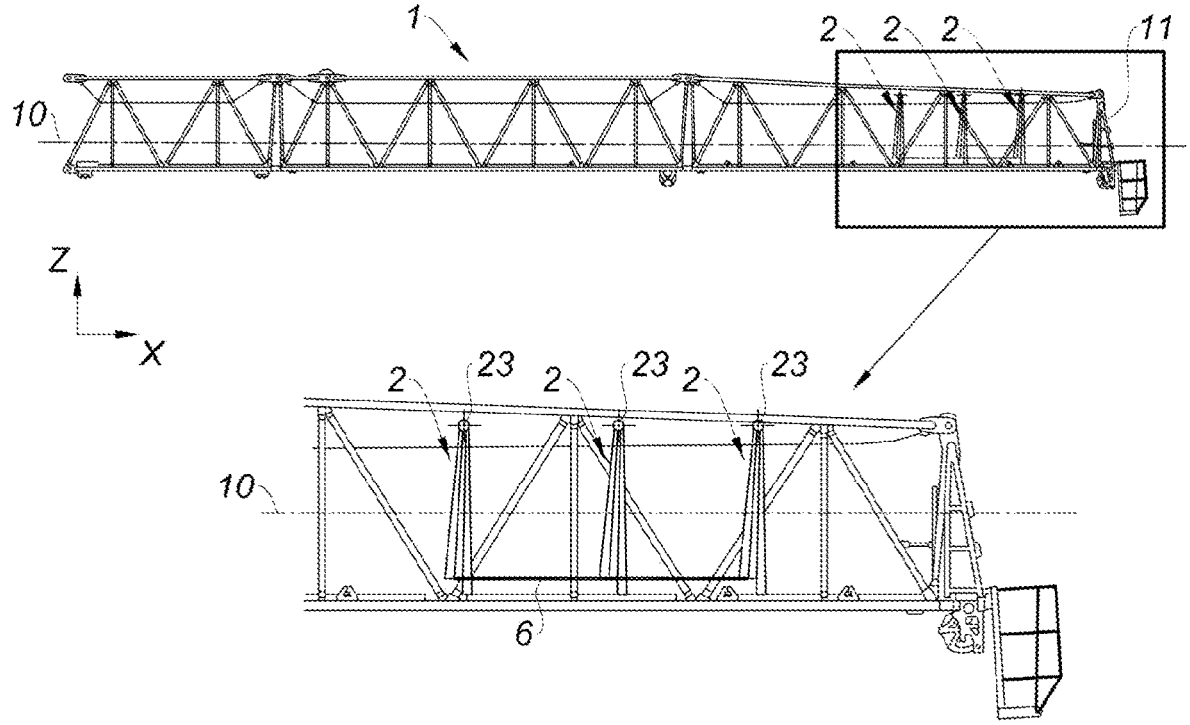
FIG. 1 is a schematic side and partial view of a boom of a tower crane according to the invention, the boom being in the lowered position and supporting a first wind load system according to the invention and which is in the retracted position.

A tower crane according to the invention comprises:

- a tower (also called a mast), extending vertically, anchored or movable on the ground; and
- a rotating portion, surmounting the tower, which is pivotally mounted on the top of the tower according to an orientation axis, which corresponds to a vertical axis parallel to the vertical direction Z illustrated in the Figures.

This rotating portion mainly comprises:

a rotating pivot forming an orientation device generally equipped with orientation brakes, this rotating pivot being mounted on the top of the tower, and it generally supports a cockpit;

a counter-boom on which is mounted a counterweight, which extends substantially horizontally rearward from the rotating pivot; and a boom 1 of the luffing boom type, which extends substantially forward, from the rotating pivot, along a longitudinal axis 10.

The rotating pivot is orientable around the orientation axis, and thus the boom 1 is pivotally mounted on the tower around the orientation axis.

The boom 1 can be formed by a lattice structure, for example of triangular section. The boom 1 has a proximal portion mounted on the rotating pivot, this proximal portion forming the base of the boom 1. The boom 1 also has a free distal portion 11 which forms the tip of the boom 1.

The proximal portion is moreover articulated, around a horizontal pivot axis, on the rotating pivot, so that the boom 1 can pivot upwards or downwards around this horizontal pivot axis, and thus this boom 1 is a so-called luffing boom in the sense that it can be displaced in elevation and lowering between:

a lowered position (visible in FIGS. 1, 3, 5 and 7) in which the boom 1 extends substantially horizontally, with the longitudinal axis 10 which is substantially parallel to a horizontal direction X; and a raised position (visible in FIGS. 2, 4, 6 and 8) in which the boom 1 extends obliquely, with the longitudinal axis 10 which is inclined relative to the horizontal direction X at an angle at least greater than 30 or 45 degrees, or even at least greater than 60 degrees, the distal portion 11 having mounted compared to the lowered position.

The tower crane can also be configured between:

a service configuration in which the boom 1 is controlled in rotation on the tower around the orientation axis, conventionally by means of an orientation motorization dedicated to turn the rotating portion; and a weather vane configuration in which the boom 1 is in the raised position and is released in rotation on the tower around the orientation axis to be able to be oriented in the direction of the wind, for example after disengaging the orientation brakes provided on the rotating pivot.

According to the invention, the tower crane further comprises at least one wind load system 2, 3, 4, 5 which is mounted on the boom 1 and which is adjustable between:

a retracted shape used in the service configuration and in which the wind load system 2, 3, 4, 5 (visible in FIGS. 1, 3, 5 and 7) offers a reduced surface exposed to the wind, and a deployed shape (visible in FIGS. 2, 4, 6 and 8) used in the weather vane configuration (therefore when the boom 1 is in the raised position) and in which the wind load system 2, 3, 4, 5 provides an extended wind surface that is greater than the reduced surface exposed to the wind.

Figure 2:
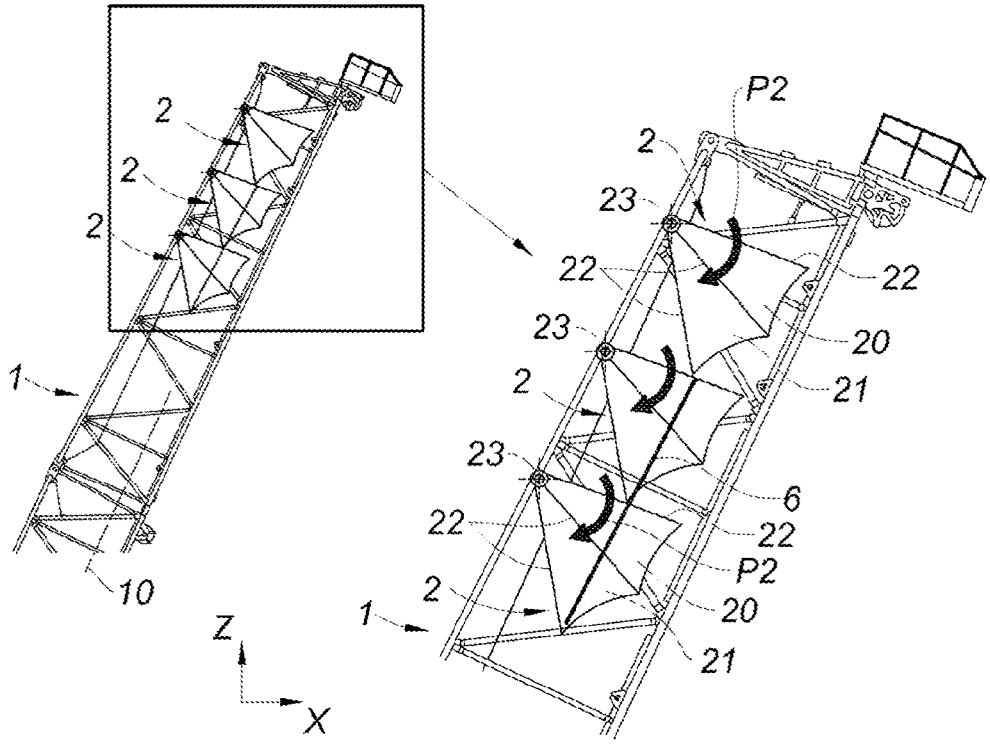
FIG. 2 is a schematic side and partial view of the boom of FIG. 1, the boom being in the raised position and the first wind load system being in the deployed position.
Figure 3:
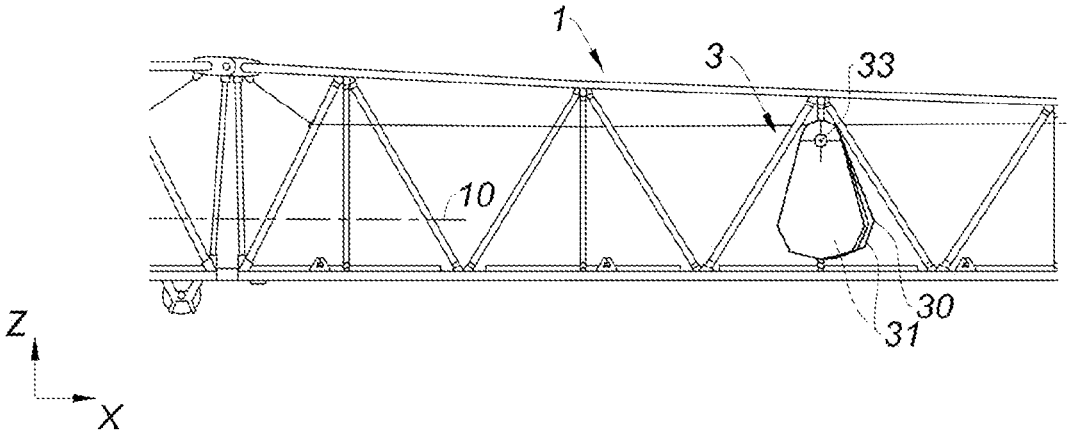
FIG. 3 is a schematic side and partial view of a boom of a tower crane according to the invention, the boom being in the lowered position and supporting a second wind load system according to the invention and which is in the retracted position.
Figure 4:
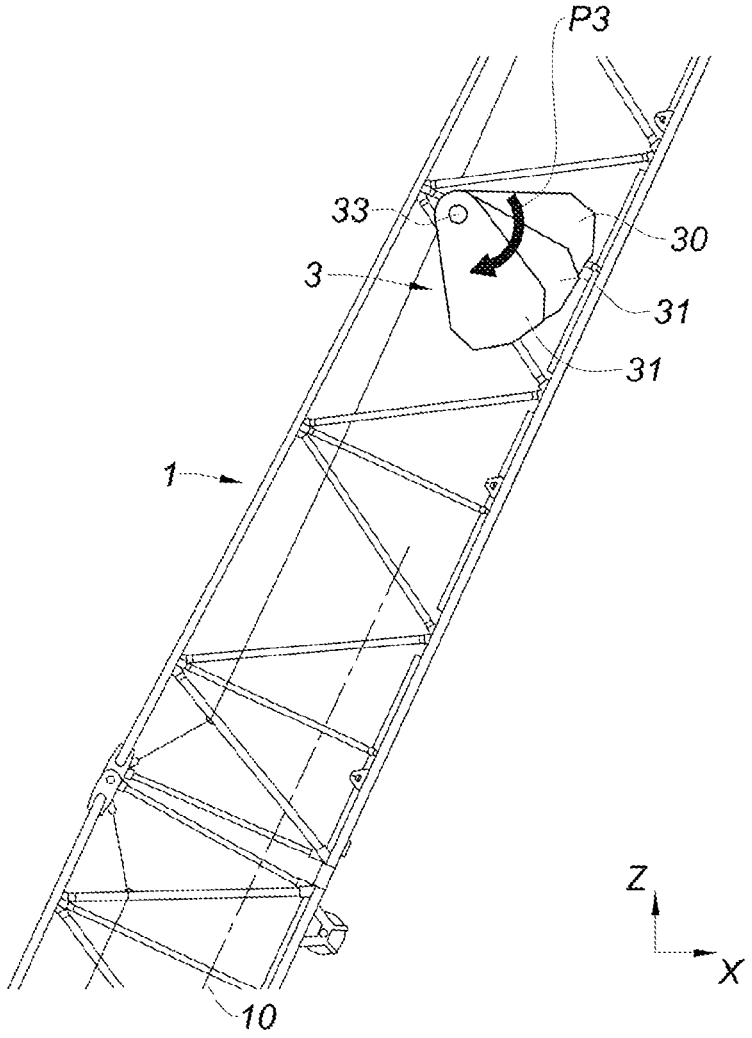
FIG. 4 is a schematic side and partial view of the boom of FIG. 3, the boom being in the raised position and the second wind load system being in the deployed position.
Figure 5:
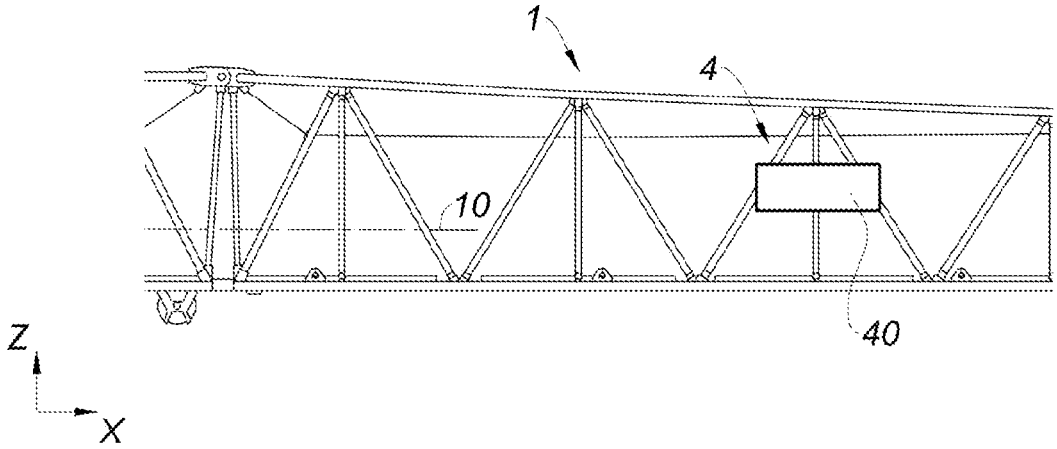
FIG. 5 is a schematic side and partial view of a boom of a tower crane according to the invention, the boom being in the lowered position and supporting a third wind load system in accordance with the invention and which is in the retracted position.
Figure 6:
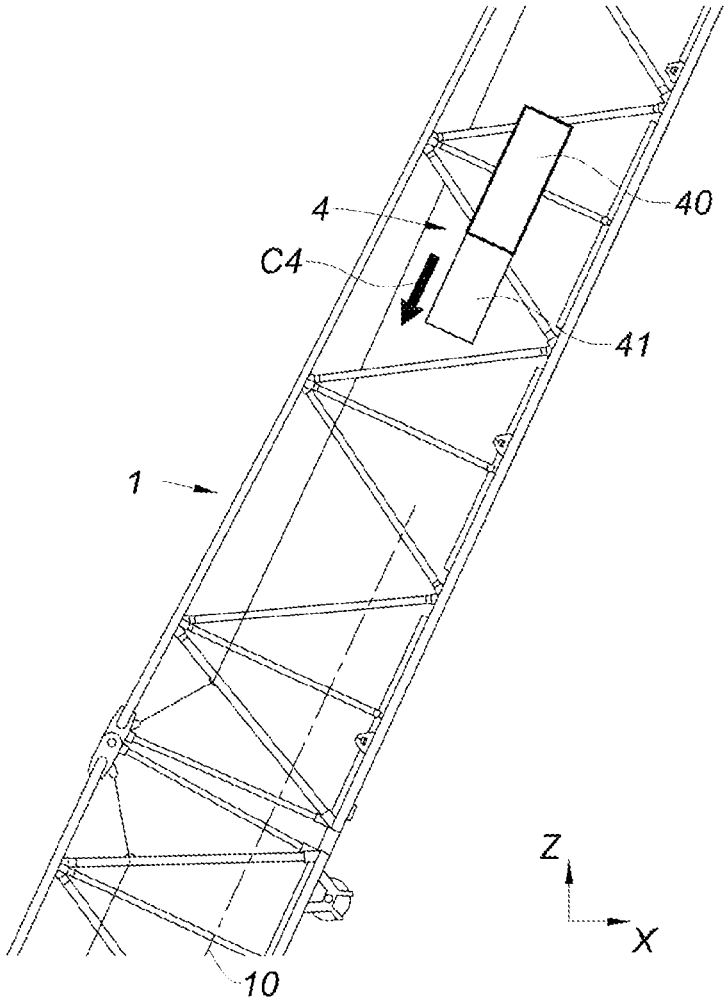
FIG. 6 is a schematic side and partial view of the boom of FIG. 5, the boom being in the raised position and the third wind load system being in the deployed position.
Figure 7:
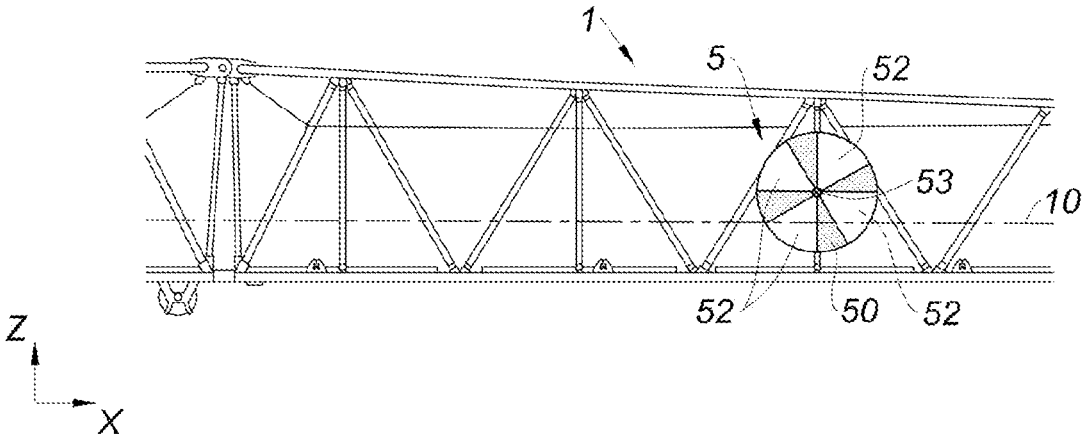
FIG. 7 is a schematic side and partial view of a boom of a tower crane according to the invention, the boom being in the lowered position and supporting a fourth wind load system according to the invention and which is in the retracted position.
Figure 8:
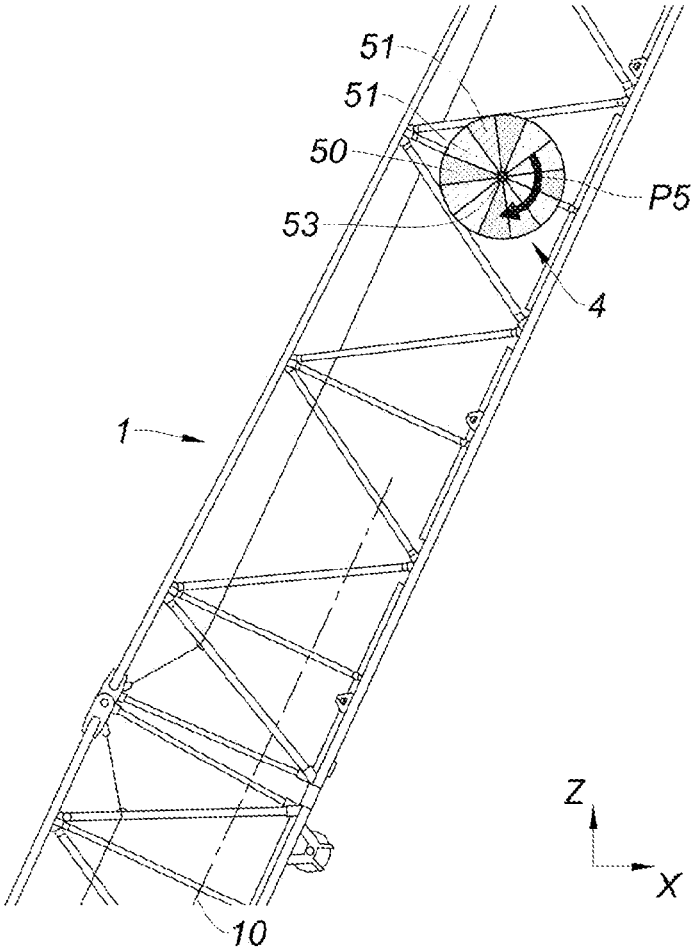
FIG. 8 is a schematic side and partial view of the boom of FIG. 7, the boom being in the raised position and the fourth wind load system being in the deployed position.

Four exemplary embodiments of a wind load system 2, 3, 4, 5 are illustrated in FIGS. 1 to 8, with a first wind load system 2 in FIGS. 1 and 2, a second wind load system 3 in FIGS. 3 and 4, a third wind load system 4 in FIGS. 5 and 6 and a fourth wind load system 5 in FIGS. 7 and 8.

In general, the wind load system 2, 3, 4, 5 is designed to:

move from the retracted shape to the deployed shape under the effect of its own weight alone (in other words under the effect of gravity) when the boom 1 is raised to move from the lowered position to the raised position, and vice versa to move from the deployed shape to the retracted shape under the effect of its own weight alone (in other words under the effect of gravity) when the boom 1 is lowered to move from the raised position to the lowered position.

In the four illustrated embodiments, the wind load system 2, 3, 4, 5 comprises at least two wing elements 20, 21, 30, 31, 40, 41, 50, 51, the wing elements including one or more freely movable wing element 20, 21, 31, 41, 51, where:

in the retracted shape, the wing elements 20, 21, 30, 31, 40, 41, 50, 51 are at least partially superimposed on each other when the boom 1 is in the lowered position in order to provide the reduced surface exposed to the wind; and in the deployed shape, the wing elements 20, 21, 30, 31, 40, 41, 50, 51 are spaced apart from each other when the boom 1 is in the raised position in order to provide the extended surface exposed to the wind.

For example, the freely movable wing element(s) 20, 21, 31, 41, 51 are freely displaced under the effect of their own weight alone (in other words under the effect of gravity) when the boom 1 is raised to move from the lowered position to the raised position (and vice versa to move from the raised position to the lowered position).

It is advantageous to provide, for each freely movable wing element 20, 21, 31, 41, 51:

a first stop to stop this freely movable wing element in its mobility, when the boom 1 is raised, so as to stop it in an optimal deployed position to provide a surface exposed to the wind which is maximized, once the boom 1 in raised position; and a second stop to stop this freely movable wing element in its mobility, when the boom 1 is lowered, so as to stop it in an optimal retracted position to provide a surface exposed to the wind which is minimized (by overlapping between the wing elements), once the boom 1 is in the lowered position.

In the first wind load system 2, the wing elements 20, 21 are in the form of flexible bellows, for example made of textile material, which are mounted on rigid frames 22 which pivot on the boom 1 around the same transverse pivot axis 23 which is both orthogonal to the vertical direction Z and to the longitudinal axis 10, this transverse pivot axis 23 being horizontal, regardless of the position of the boom 1. The wing elements 20, 21 of this first wind load system 2 are all free to move.

In the retracted shape, the wing elements 20, 21 are superimposed and folded over one another. When the boom 1 is raised, the rigid frames 22 of the wing elements 20, 21 pivot (as shown diagrammatically by the arrow P2) about the transverse pivot axis 23 (under the effect of their weight) and thus the wing elements 20, 21 are deployed, providing an increase in the surface exposed to the wind (like a fan).

In the second wind load system 3, the wing elements 30, 31 are in the form of wind plates, for example in rigid metallic, composite or plastic material or in flexible material mounted on a rigid frame, and comprise:

one or more freely movable wing elements 31 which are pivotally mounted on the boom 1 around the same transverse pivot axis 33 which is both orthogonal to the vertical direction Z and to the longitudinal axis 10, this transverse pivot axis 23 being horizontal, regardless of the position of boom 1; and a static wing element 30, which remains static and does not pivot during the raising of the boom 1.

In the example illustrated, the freely movable wing elements 31 are two in number. In the retracted shape, the wing elements 30, 31 are superimposed on each other. When the boom 1 is raised, the freely movable wing elements 31 pivot (as shown diagrammatically by the arrow P3) about the transverse pivot axis 33 (under the effect of their weight) and thus the freely movable wing elements 31 are deployed and moved away from the static wing member 30, providing an increase in the surface exposed to the wind.

In the third wind load system 4, the wing elements 40, 41 are in the form of wind plates, for example made of rigid metallic, composite or plastic material or of flexible material mounted on a rigid frame, and comprise:

one or more freely movable wing elements 41 which are slidably mounted on the boom 1 along the longitudinal axis 10; and a static wing element 40, which remains static and does not slide during the raising of the boom 1.

In the illustrated example, the freely movable wing element(s) 41 are one in number. In the retracted shape, the wing elements 40, 41 are superimposed on each other. When the boom 1 is raised, the freely movable wing element(s) 31 slide (as shown diagrammatically by the arrow C4) the longitudinal axis 10 (under the effect of their weight) and thus the freely movable wing element(s) 41 are deployed and moved away from the static wing member 40, providing an increase in the surface exposed to the wind (like an opening drawer).

In the fourth wind load system 5, the wing elements 50, 51 are in the form of wind plates, for example in rigid metallic, composite or plastic material or in flexible material mounted on a rigid frame, and comprise:

one or more freely movable wing elements 51 which are pivotally mounted on the boom 1 around the same transverse pivot axis 53 which is both orthogonal to the vertical direction Z and to the longitudinal axis 10, this transverse pivot axis 53 being horizontal, regardless of the position of boom 1; and a static wing element 50, which remains static to it and does not pivot during the raising of the boom 1, wherein this static wing element 50 is in the form of a disc centered on the transverse pivot axis 53 and provided with several windows 52.

In the retracted shape, the wing elements 50, 51 are superimposed on each other so that the freely movable wing elements 51 release the windows 52. When the boom 1 is raised, the freely movable wing elements 51 pivot (as shown diagrammatically by the arrow P5) about the transverse pivot axis 53 (under the effect of their weight) and thus the freely movable wing elements 51 are deployed and moved away from the static wing element 50 in order to occupy or cover the windows 52, providing an increase in the surface exposed to the wind (in the manner of an air vent).

In the example of FIGS. 1 and 2, the tower crane comprises several wind load systems 2, which can be connected by a link bar 6 for parallel and synchronized movements, both in deployment and in retraction.

It should moreover be noted that, in view of the simplicity of these wind load systems 2, 3, 4, 5, which do not use any actuator, it is easy to install such wind load systems 2, 3, 4, 5 either as original equipment (in other words for the manufacture of the tower crane), or during an upgrade or improvement of an existing tower crane.

The invention claimed is:

1. A tower crane comprising:

a tower on which a boom is pivotally mounted around an orientation axis, wherein the boom is displaceable in elevation and in lowering between a lowered position and a raised position, and wherein tower crane is configurable between a service configuration in which the boom is controlled in rotation on the tower around the orientation axis, and a weather vane configuration in which the boom is in the raised position and is released in rotation on the tower around the orientation axis to allow for orientation in the direction of the wind; and at least one wind load system mounted on the boom and adjustable between a retracted shape used in the service configuration and a deployed shape in the weather vane configuration, wherein the wind load system, in the retracted shape, has a reduced surface exposed to wind, and in the deployed shape, has an extended surface exposed to wind, the extended surface greater than the reduced surface exposed to wind, and wherein the wind load system is configured to move from the retracted shape towards the deployed shape under the effect of its own weight alone when the boom is raised to move from the lowered position to the raised position, and wherein the wind load system is configured to move from the deployed shape towards the retracted shape under the effect of its own weight alone when the boom is lowered to move from the raised position to the lowered position.

2. The tower crane according to claim 1, wherein the wind load system comprises at least two wing elements, and the wing elements include at least one freely movable wing element, wherein:

in the retracted shape, the wing elements are at least partially superimposed on each other when the boom is in the lowered position to provide the reduced surface exposed to the wind, and in the deployed shape, the wing elements are spaced apart when the boom is in the raised position to provide the extended surface exposed to the wind;

wherein the at least one freely movable wing element is freely displaced under the effect of its own weight alone when the boom is raised to move from the lowered position to the raised position.

3. The tower crane according to claim 2, wherein the at least one freely movable wing element is movable at least in rotation.

4. The tower crane according to claim 3, wherein the at least one freely movable wing element includes a plurality of freely movable wing elements, and the freely movable wing elements are movable in rotation about a same axis of rotation.

5. The tower crane according to claim 2, wherein the at least one freely movable wing element is movable at least in sliding.

6. The tower crane according to claim 2, wherein the wing elements further include a static wing element, and the at least one freely movable wing element is superimposed at least partially in front of or behind the static wing element in the retracted shape.

7. The tower crane according to claim 2, wherein the wing elements of the wind load system are made at least partially in a material selected from: a metallic material, a plastic material, a textile material, and a composite material.

8. The tower crane according to claim 2, wherein the wing elements of the wind load system are planar and parallel to each other in the deployed shape.

9. A securing method for securing a tower crane according claim 1, the method comprising:

releasing the boom in rotation on the tower around the orientation axis, to allow for orientation in the direction of the wind; and raising the boom to move from the lowered position in which the wind load system is in the retracted shape towards the raised position in which the wind load system is in the deployed shape, wherein, during the raising of the boom, the wind load system moves from the retracted shape towards the deployed shape under the effect of its own weight alone.

10. The securing method according to claim 9, wherein the wind load system comprises at least two wing elements, and the wing elements include at least one freely movable wing element, wherein, in the retracted shape, the wing elements are at least partially superimposed on each other when the boom is in the lowered position to provide the reduced surface exposed to the wind, wherein, in the deployed shape, the wing elements are spaced apart when the boom is in the raised position to provide the extended surface exposed to the wind, wherein the at least one freely movable wing element is freely displaced under the effect of its own weight alone when the boom is raised to move from the lowered position to the raised position, and wherein, during the raising of the boom, the at least one freely movable wing element is freely displaced under the effect of its own weight alone to increase the surface exposed to the wind of the wind load system.

* * * * *